US005730622A

United States Patent [19]

Olson

[11] Patent Number: 5,730,622

[45] Date of Patent: Mar. 24, 1998

[54] COAX CONNECTOR

[75] Inventor: Cynthia G. Olson, Carver, Minn.

[73] Assignee: ADC Telecommunications, Inc., Minneapolis, Minn.

[21] Appl. No.: 656,951

[22] Filed: Jun. 6, 1996

[51] Int. Cl.[6] ..... H01R 9/05

[52] U.S. Cl. ..... 439/578; 439/675

[58] Field of Search ..... 439/578, 675, 439/585, 731

[56] References Cited

U.S. PATENT DOCUMENTS

| | | | |
|---|---|---|---|
| 2,642,474 | 6/1953 | Bowar | 439/462 |
| 3,663,901 | 5/1972 | Forney, Jr. | 439/585 |
| 3,678,447 | 7/1972 | Ziegler, Jr. et al. | 439/585 |
| 5,123,864 | 6/1992 | Karlovich | 439/585 |
| 5,269,702 | 12/1993 | Bacher et al. | 439/578 |
| 5,387,116 | 2/1995 | Wang | 439/188 |
| 5,387,127 | 2/1995 | Wang | 439/582 |
| 5,467,062 | 11/1995 | Burroughs | 439/34 |

*Primary Examiner*—Hien Vu
*Assistant Examiner*—Brian J. Biggi
*Attorney, Agent, or Firm*—Merchant, Gould, Smith, Edell, Welter & Schmidt, P.A.

[57] ABSTRACT

A coax connector includes an electrically conductive housing and electrically conductive center conductor. The center conductor is axially positioned within the housing in a dielectric support. The support includes two identical halves which are joined together to securely capture the center conductor.

6 Claims, 10 Drawing Sheets

COAX CONNECTOR

I. BACKGROUND OF THE INVENTION

1. Field of the Invention

This invention pertains to coax connectors for use in the telecommunications industry. More particularly, this invention pertains to a coax connector with a novel dielectric support for containing a center conductor axially positioned within a housing of the connector.

2. Description of the Prior Art

Coax connectors are widely used in the telecommunications industry. Such connectors include an electrically conductive center conductor axially positioned within an electrically conductive housing. The center conductor is secured within the housing by a dielectric support. The dielectric support presents a geometry which in combination with the geometry of the housing and the center conductor provide a connector having a desired electrical impedance. Commonly, in the telecommunications industry, connectors are designed for a 75 ohm characteristic impedance.

In addition to retaining a center conductor axially positioned within the housing of the conductor, it is desirable that the center conductor be secured from axial movement. Any axial movement can result in disrupting electrical connection between the center conductor and a pin inserted into the center conductor.

II. SUMMARY OF THE INVENTION

According to a preferred embodiment of the present invention, a coax connector is provided which includes an electrically conductive housing having an internal bore. An electrically conductive center conductor is disposed within the bore. The center conductor has a body portion and a contact portion. The contact portion includes two spring members which extend from the body portion.

Opposing surfaces of the spring members define a pin-receiving bore. The spring members are resilient to be urged apart from a rest position to a deflected position upon insertion of a pin into the pin-receiving bore. The center conductor has a raised stop surface facing toward the body portion. A dielectric support holds the center conductor axially positioned within the bore of the housing. The dielectric support includes first and second enlarged portions which are sized to be snugly received within the bore of the housing. The support further includes a reduced sized portion connecting the first and second enlarged portions. The reduced sized portion is spaced from the housing to define an annular air chamber surrounding the reduced sized portion. The dielectric support has an internal support bore into which the center conductor is received. The support bore has a first portion which is sized to contact the body portion of the center conductor in close contact. The support bore further has a second portion which is sized and positioned to surround the spring members and be spaced from the spring members to permit deflection of the spring members. The support includes a portion opposing the stop surface of the center conductor to prevent axial movement.

III. BRIEF DESCRIPTION OF THE DRAWINGS

IV. DESCRIPTION OF THE PREFERRED EMBODIMENT

With reference now to the various drawing figures in which identical elements are numbered identically throughout, a description of the preferred embodiment of the present invention will now be provided.

Figure 1:
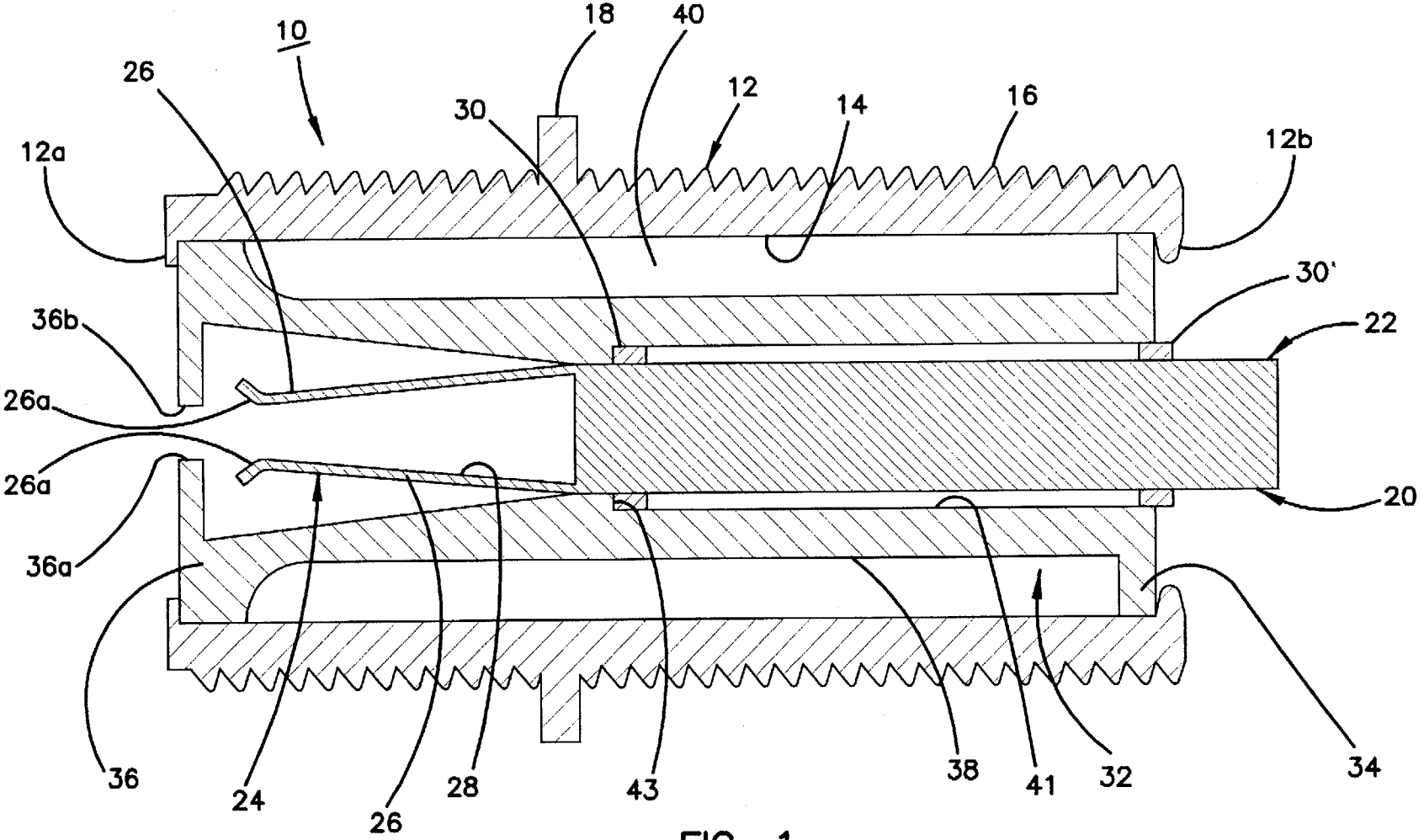
FIG. 1 PRIOR ART
FIG. 1 is a schematic side longitudinal section view of a prior art coax connector.

Initial attention is directed to FIG. 1 which illustrates in schematic format a coax connector of the prior art. The prior art coax connector 10 includes an electrically conductive housing 12 having an internal and axially extending bore 14. Although not essential, the external surface of the housing 12 is threaded with external threads 16 and may include a flange or nut 18 to permit mounting of the connector 10 to a panel or the like.

Within the housing 12, a center conductor 20 is provided. The center conductor 20 includes a generally solid and cylindrical body portion 22 and a contact portion 24. The body portion 22 includes raised ribs 30. The contact portion 24 includes two spaced apart spring members 26 which are outwardly flared at their distal ends 26*a*. Opposing surfaces of the spring members 26 define a pin-receiving bore 28 so that a center pin (not shown) of a mating connector may be inserted within the pin-receiving bore 28 and electrical contact made between the spring members 26 and the inserted pin at the distal ends 26*a*.

A dielectric support 32 surrounds the center conductor 20 and retains it in axial alignment within the bore 14. The dielectric support 32 includes a first radial flange 34 surrounding the body portion 22 and a second radial flange 36 adjacent the distal end 26*a* of the spring members 26. The enlarged portions 34, 36 are sized to be snugly received within the bore 14. A reduced diameter portion 38 connects the enlarged portions 34, 36. The reduced diameter portion 38 remains spaced from the housing 12 to define an air annular chamber 40 surrounding the reduced diameter portion 38.

At the front end of the connector 10, the second enlarged portion 36 is provided with inwardly protruding portions 36*a* terminating at an axial opening 36*b*. The portions 36*a* provide protective covering for the distal ends 26*a*. The opening 36*b* is sized to permit passage of a pin into the pin-receiving bore 28.

The dielectric support 32 includes an axially extending bore 41 into which the center conductor 20 is placed. The geometry of bore 41 is selected such that the bore 41 is sized to permit deflection of the spring members 26 as a center pin is placed between the springs 26 and into the pin-receiving bore 28.

The support 32 includes a stop surface 43 to limit insertion of the conductor 20 from further movement to the left of the view of FIG. 1. Accordingly, the center conductor 20 may be passed into the bore 41 with the rib 30 abutting the surface 43 when the center conductor is fully inserted within the dielectric support 32. The subassembly of the dielectric support 32 and the center conductor 20 is then inserted into the bore 14 of the housing. The front end of the housing 12 includes inwardly protruding ring 12*a* against which the support 32 abuts on full insertion. Following full insertion, a trailing end may be coined or rolled over to provide a rear flange 12*b* to securely capture the support 32 within the housing 12.

It has been found with the structure thus described, that the center conductor 20 may be dislodged from the dielectric support 32 following final assembly. Namely, with reference to the schematic showing of FIG. 1, the center conductor 20 can be moved rearwardly (i.e., to the right in FIG. 1) which is undesirable as well as being rotated within bore 41. It is also believed that the structure as shown in FIG. 1 is not adequately tuned to provide desired electrical impedance.

Having thus described prior art connector 10, attention is now directed to the remaining figures where an improved coax connector 100 of the present invention is illustrated.

Coax connector 100 includes an electrically conductive housing 102. The housing 102 has a front end 104 and a rear end 106. The front or entrance end 104 and the rear end 106 are separated by an annular ring 108. An outer surface of the housing 102 at the front end 104 is provided with threading 110 for attachment of a mating connector (not shown). The outer surface of the housing 102 at the rear end 106 is provided with knurling 112 for press fitting the connector into a subassembly (not shown). The housing 102 is hollow and has an internal bore 114 extending axially through the housing 102.

The housing 102 contains an electrically conductive center conductor 116. The center conductor 116 is separately shown in FIGS. 6–9.

Figure 6:
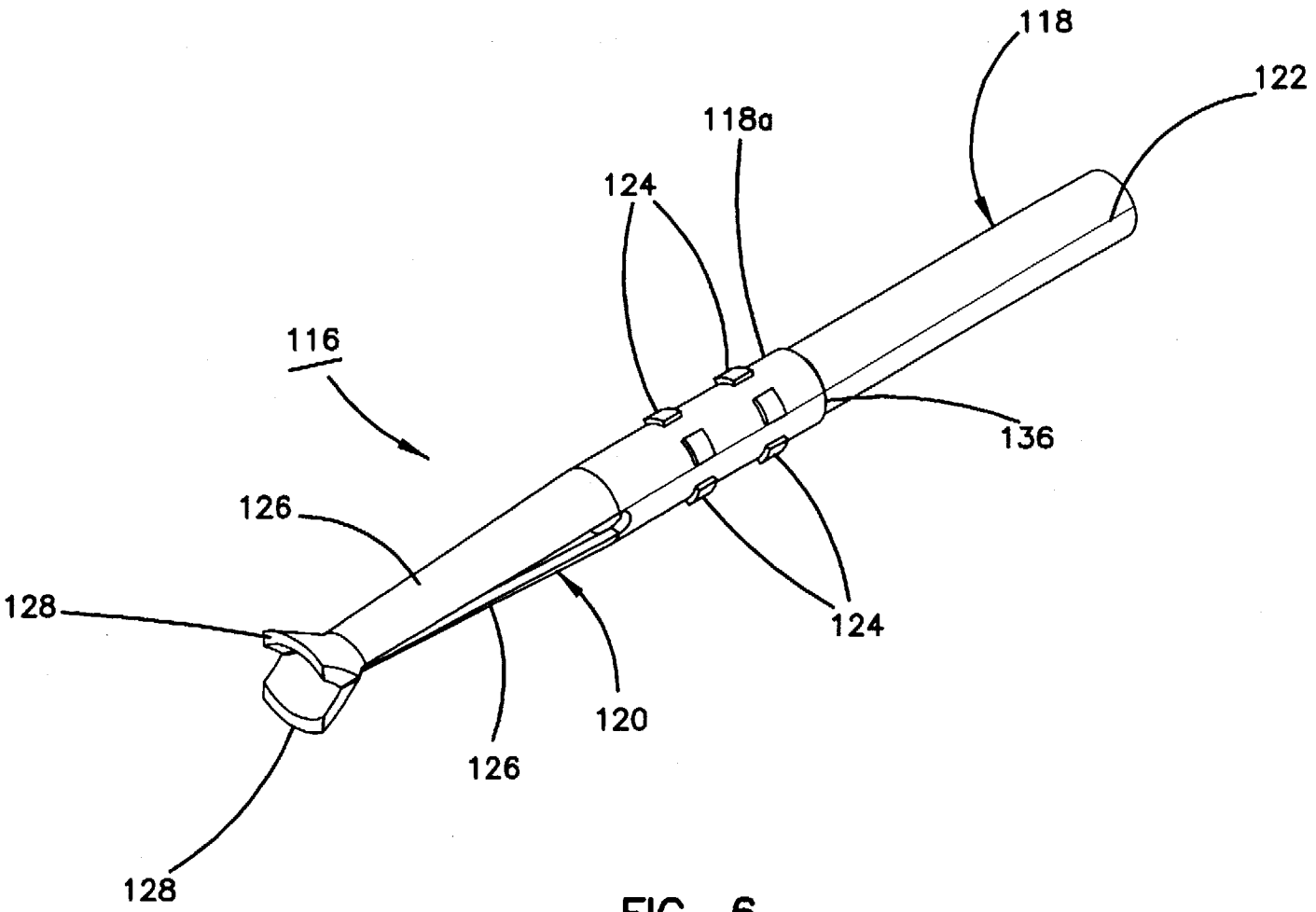
FIG. 6 is a perspective view of a center conductor for use in the connector of FIG. 2.
Figure 7:
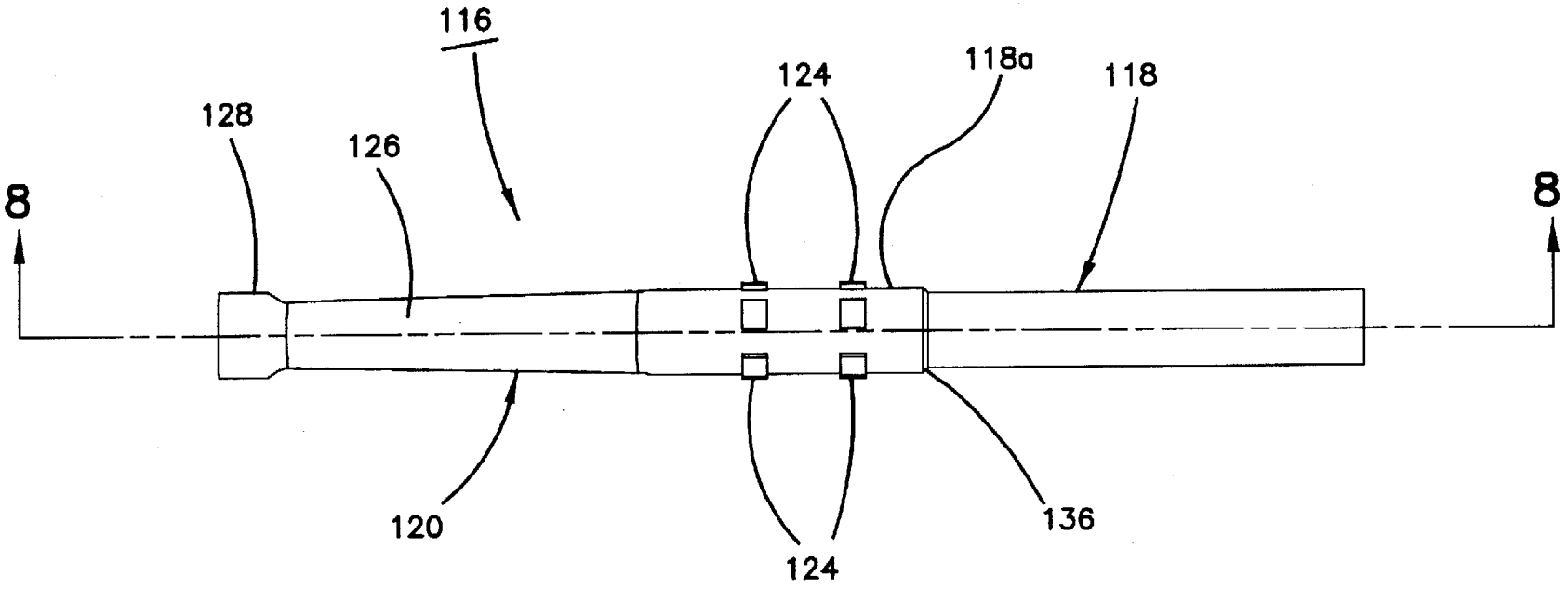
FIG. 7 is a side elevation view of the center conductor of FIG. 6.

The center conductor 116 includes a body portion 118 and a contact portion 120. Preferably, the center conductor 116 is formed from sheet metal which is preferably beryllium nickel which is stamped and then rolled to form the generally cylindrical shape of the center conductor 116. FIG. 6 illustrates a separation line 122 formed as the center conductor 116 is rolled from the sheet material. While, in a preferred embodiment, the entire center conductor 116 is formed of beryllium nickel, it is anticipated that an alternative design will include a center conductor where the contact portion 120 is formed of beryllium nickel and the body portion 118 is formed of phosphorous bronze. The beryllium nickel and phosphorous bronze may be welded or otherwise joined together in the same geometry shown in FIGS. 6–9.

The body portion 118 includes raised barbs 124. The barbs 124 are circumferentially and axially spaced about the body portion 118.

The contact portion 120 includes at least two spring members 126 which extend from the body portion 118 and terminate at distal ends 128. The spring members 126 have opposing surfaces which define a pin-receiving bore 130 (FIG. 8).

Figure 4:
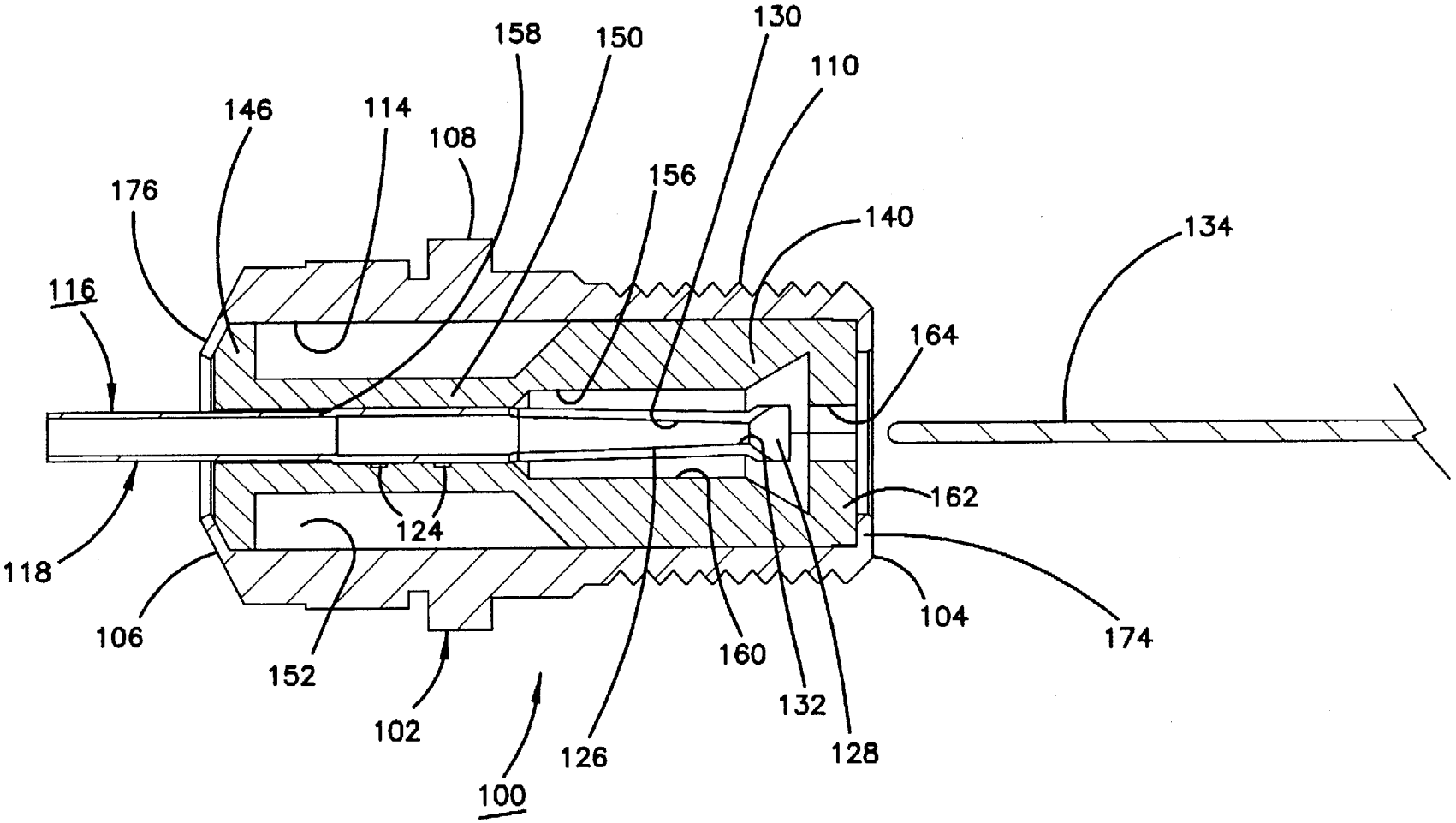
FIG. 4 is a view taken along lines 4—4 of FIG. 3.
Figure 5:
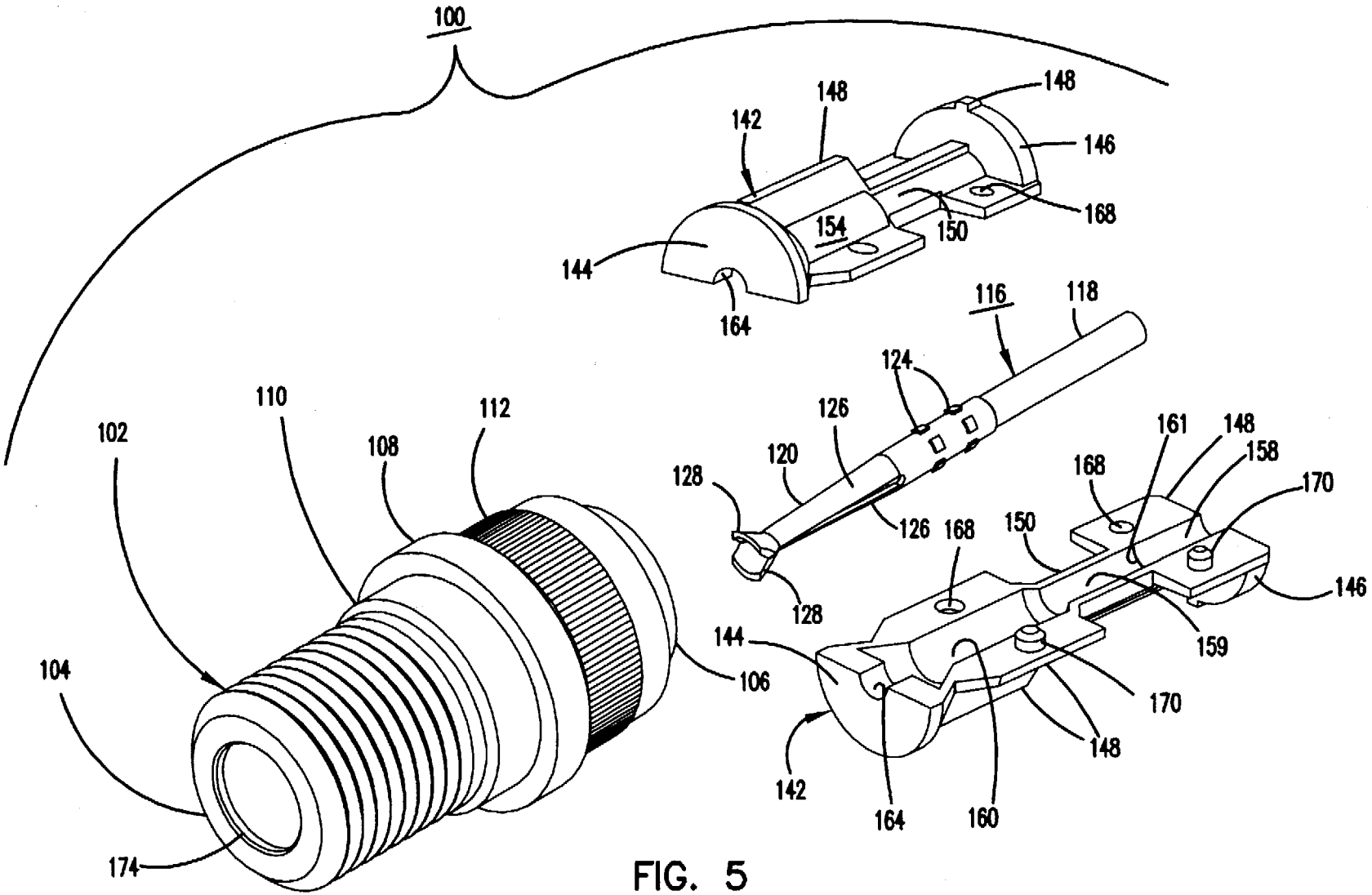
FIG. 5 is an exploded perspective view of the connector of FIG. 2 showing internal elements.
Figure 8:
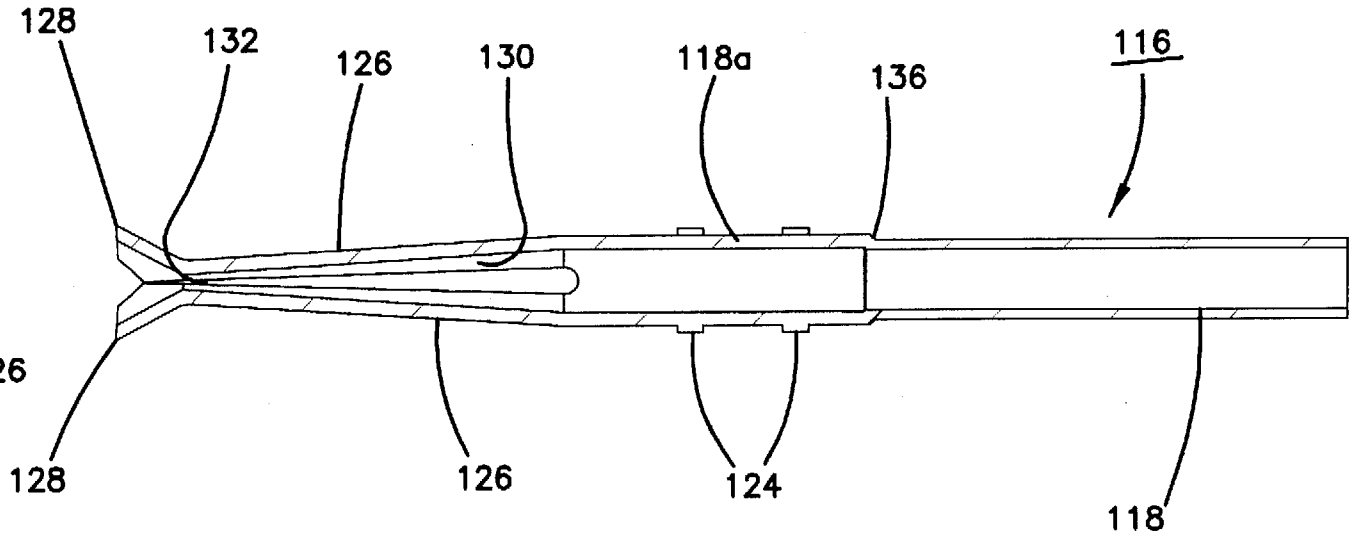
FIG. 8 is a view taken along line 8—8 of FIG. 7.
Figure 9:
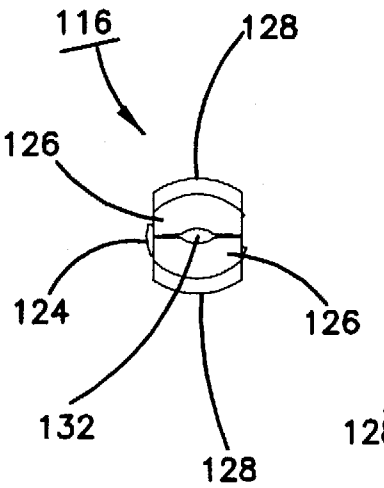
FIG. 9 is a front elevation view of the center conductor of FIG. 6.

The spring members 126 are shown in a rest position in FIG. 8 where the spring members are angled inwardly toward the longitudinal axis of the center conductor 116 to a narrow point having a gap 132 between the spring members 126. The gap 132 defines an insert end to the pin-receiving bore 130. The distal ends 128 flare outwardly away from the gap 132 to define a funnel for guiding a pin 134 (shown schematically only in FIG. 4) of a mating connector (not shown).

As the pin 134 is urged through the gap 132 into the pin receiving bore 130, the resilient spring members 126 are urged apart from the rest position shown in FIG. 8 to a deflected position where the spring members 126 are spread apart to receive the pin 134. At the gap 132, the spring members 126 are in close mechanical and electrical contact with the pin 134.

The center conductor 116 is provided with the body 118 having an enlarged diameter portion 118*a* which presents a stop surface 136 facing toward the rear of the body portion 118.

Figure 10:
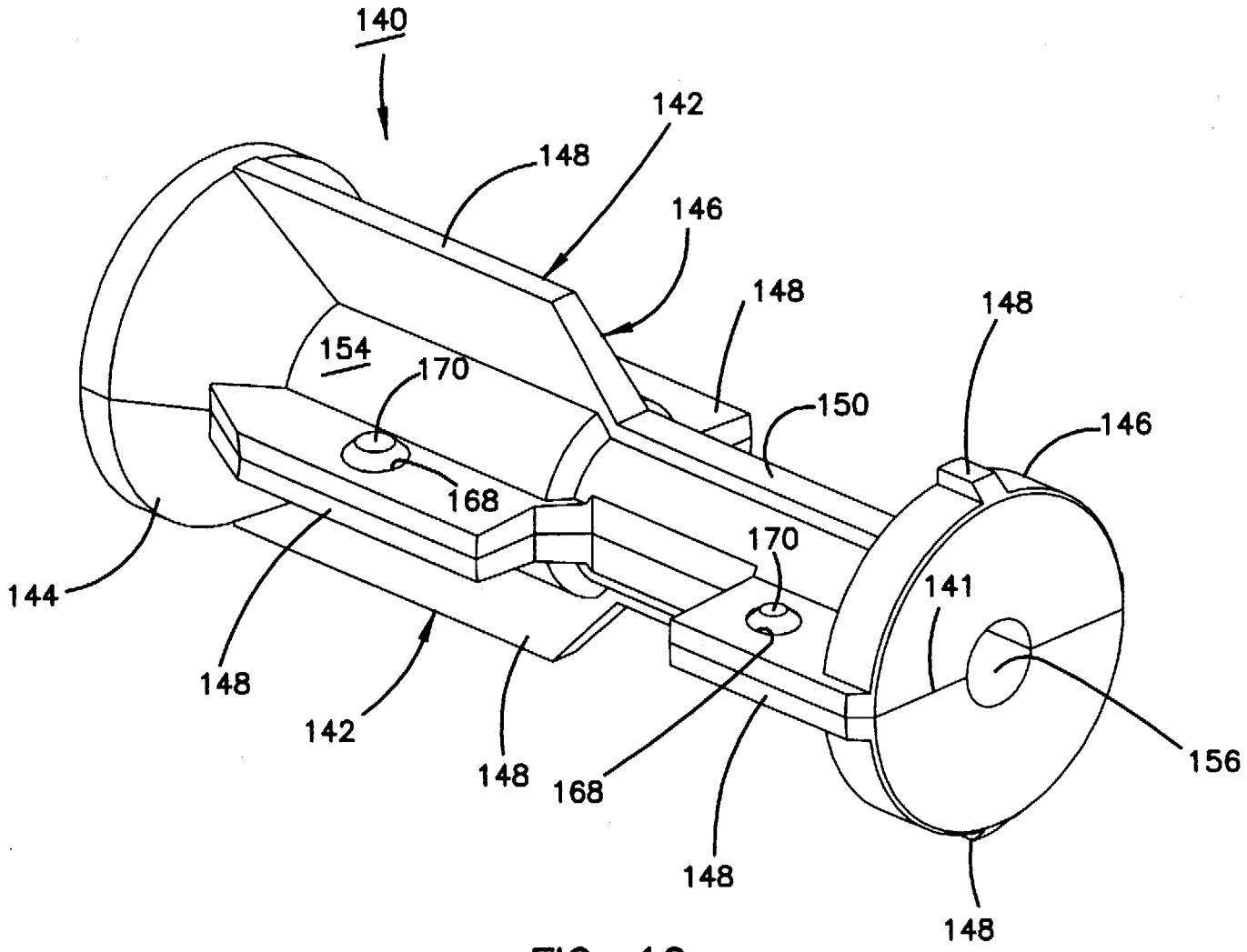
FIG. 10 is a perspective view of a dielectric support for use in the present invention showing a rear end of the support.
Figure 11:
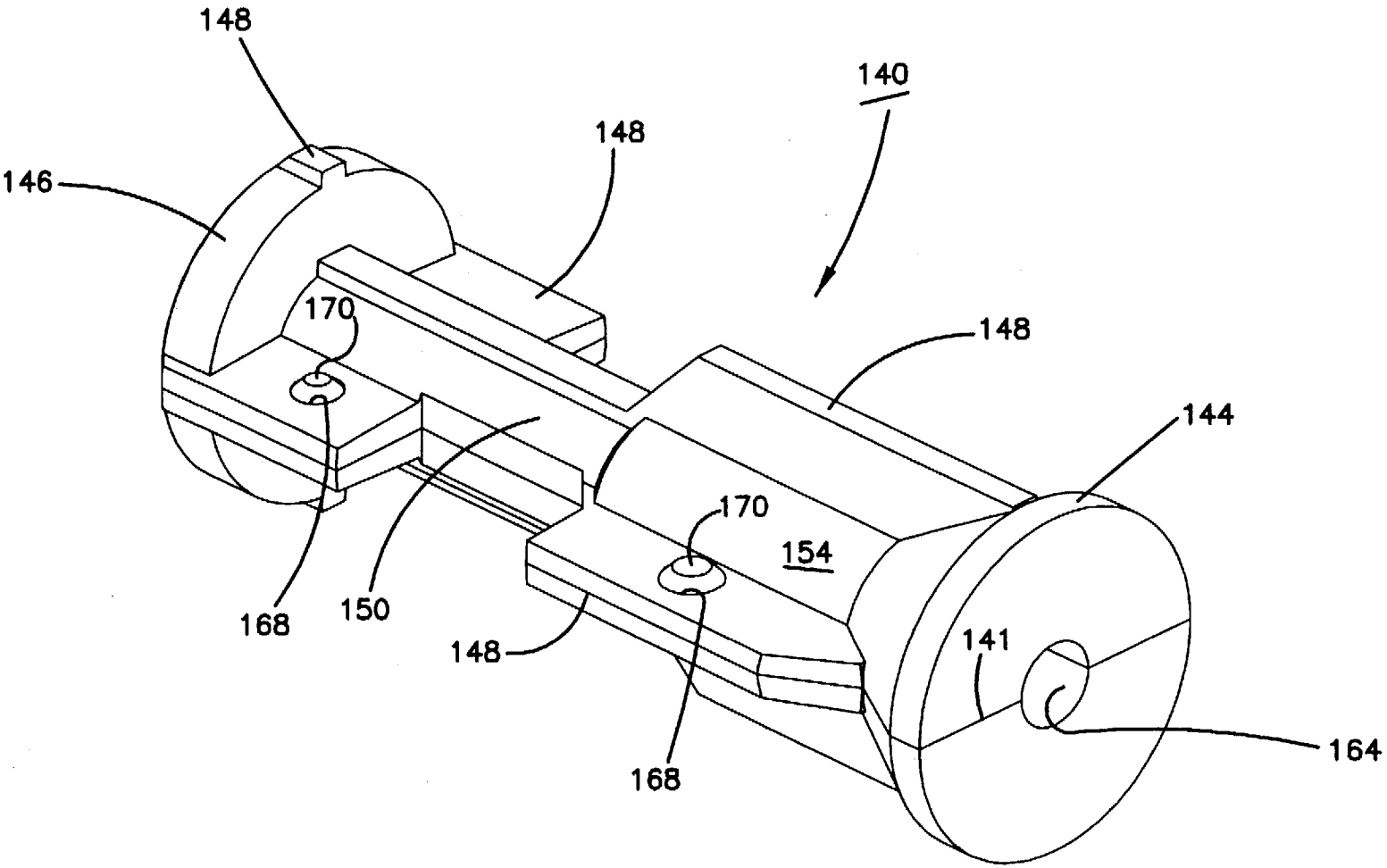
FIG. 11 is a perspective view of the support of FIG. 10 showing a front end of the support.
Figure 16:
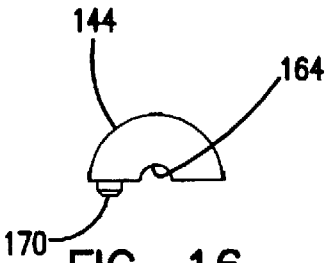
FIG. 16 is a front end view of the support half of FIG. 12.
Figure 12:
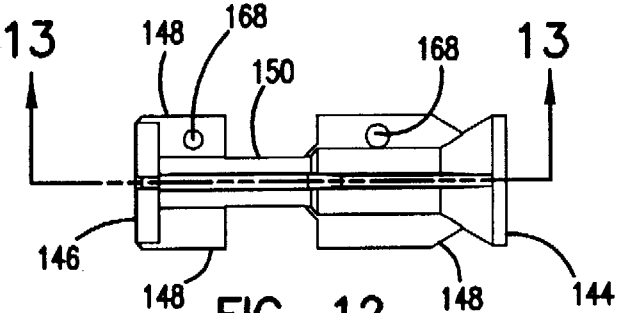
FIG. 12 is a top plan view of a mating half of the support of FIG. 10.

The center conductor 116 is held in axial alignment within the housing 102 by means of a dielectric support 140 shown separately and assembled in FIGS. 10 and 11. The dielectric support 140 is an assembly of two identical mating halves 142. When joined, the mating halves 142 define a completed dielectric support 140.

The support 140 includes a first enlarged portion 144 positioned surrounding the spring contact portion 120 of the center conductor 116. A second enlarged portion 146 surrounds the body portion 118 of the center conductor 116 at the rear end 106 of the housing 102. The enlarged portions 144, 146 are each sized to be snugly received within the internal bore 114 of the housing 102 such that the support 140 can be press fit into the housing 102 with a resistive force of 6 inch-ounce to resist movement of the support 140 within the housing 102. Both enlarged portions 144 and 146 include radially extending vanes 148 which extend generally parallel to the longitudinal axis of the center conductor 116.

The enlarged portions 144, 146 are joined by a reduced sized portion 150. The reduced sized portion 150 is spaced from the housing 102 to define annular air chamber 152 surrounding the reduced sized portion 150. Opposing surfaces of the vanes 148 define air cavities 154 (FIGS. 10 and 11). The geometry of the air chambers 152 and air cavities 154 are selected for the connector 100 to have a desired characteristic impedance. In telecommunications connectors, a common characteristic impedance of 75 ohms is attained. It will be appreciated that structuring surfaces and air cavities for the purposes of obtaining a desired impedance forms no portion of this invention per se. An example of such a teaching is shown in U.S. Pat. No. 5,467,062 to Burroughs.

Figure 13:
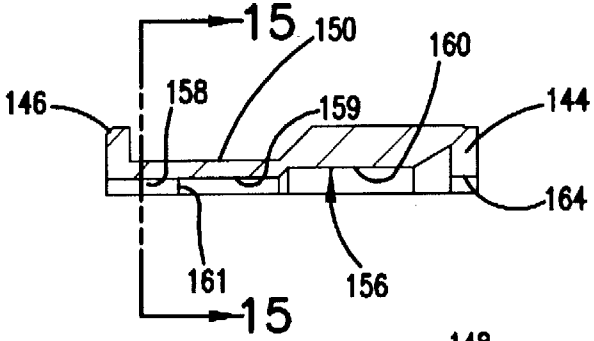
FIG. 13 is a view taken along line 13—13 of FIG. 12.
Figure 14:
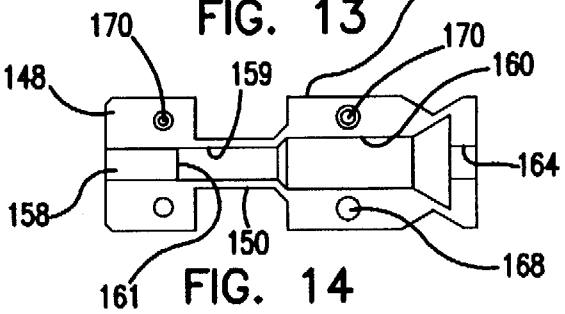
FIG. 14 is a bottom plan view of the support half of FIG. 13.
Figure 15:
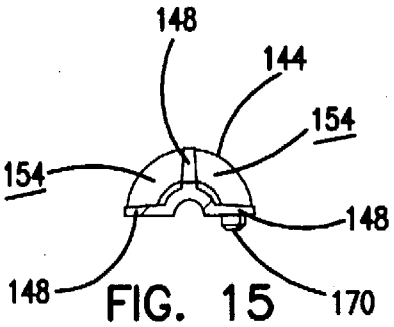
FIG. 15 is a view taken along line 15—15 of FIG. 13.

When the halves 142 are joined to form support 140, support 140 presents an internal support bore 156 extending axially through the support 140. The bore 156 includes a first portion 158 sized to surround the body portion 118 of the center conductor 116 in close contact and with material of the support 140 opposing the stop surface 136 of the center conductor 116. Shown best in FIG. 13, bore portion 158 includes an enlarged portion 159 to surround connector body portion 118*a*. A stop surface 161 opposes stop surface 136.

When the halves 142 are joined around the center conductor 116, the barbs 124 plastically deform the material of the support 140 such that the barbs 124 become imbedded into the material of the support 140 to resist both axial and rotational movement of the center conductor 116 within the support 140. Further, the material of the support opposing the stop surface 136 resists axial movement of the center conductor 116 relative to the support 140 in a direction rearwardly (i.e., in a direction to the left of the view of FIG. 4). Preferably, the support 140 is formed of material sold under the trademark ULTEM by General Electric Company and is a polyetherimide (PEI) material.

The support bore 156 also includes a second portion 160 sized and positioned to surround the spring members 126. The second portion 160 is sized such that when the spring members 126 are in the rest position, the material of the support 140 is spaced from the spring members 126. The spacing is selected to accommodate movement of the spring members 126 from the rest position to the deflected position. Further, the spacing is selected to restrict further movement of the spring members 126 beyond the deflected position to prevent the spring members 126 from deflecting to such an extended state that the spring members 126 would become plastically deformed.

The support 140 includes a forward portion 162 which is in the form of a ring positioned between the entrance end 104 of the housing and the distal ends 128 of the spring members 126. The forward portion 162 has an axial opening 164 aligned with the entrance or insert end 132 of the pin-receiving bore 130.

Figures 2, 3:
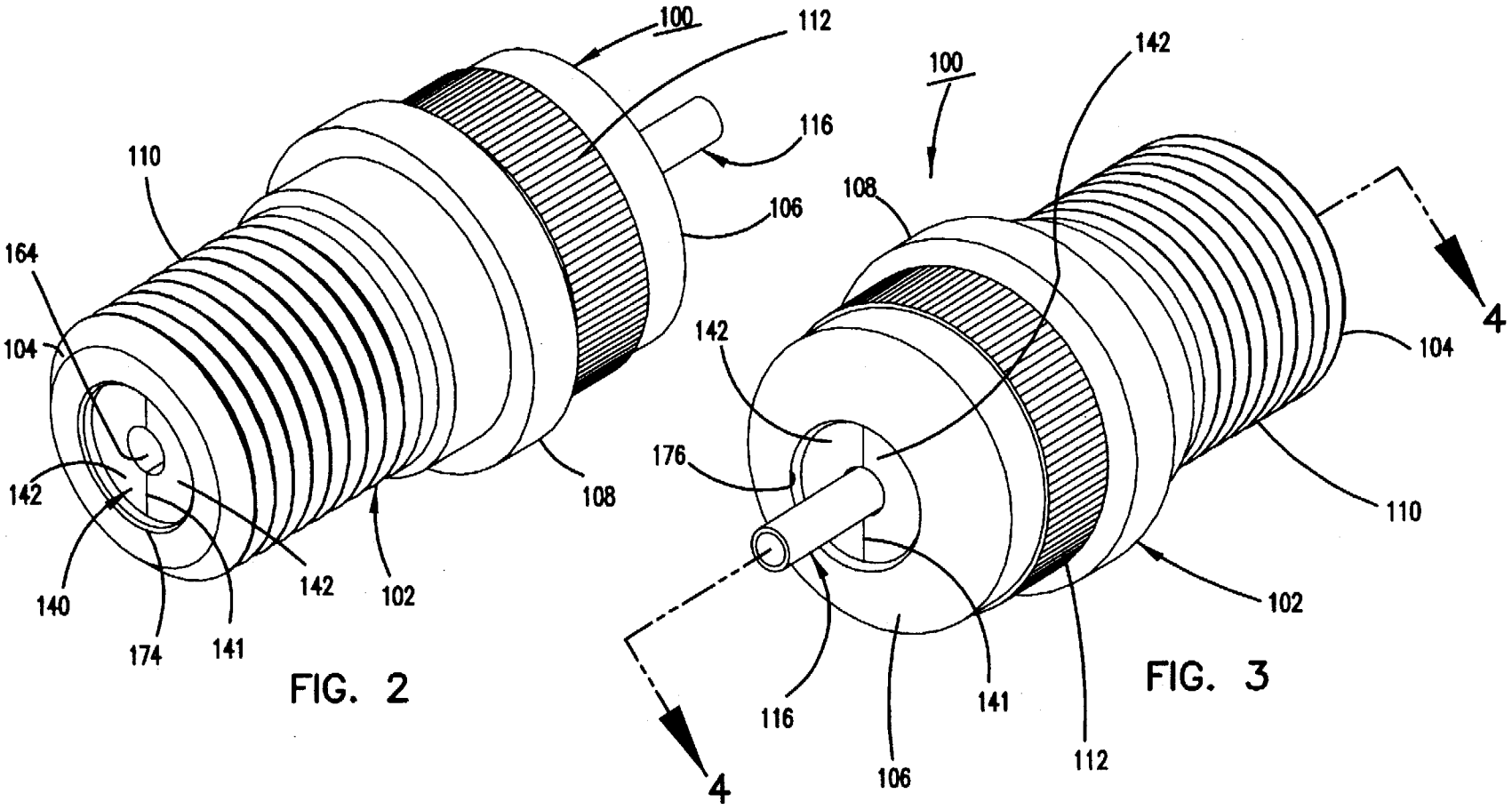
FIG. 2 is a perspective view of a coax connector according to the present invention showing a front end of the connector.
FIG. 3 is a perspective view of the connector of FIG. 2 showing a rear end of the connector.

Each of the mating halves 142 includes recesses 168 and protruding tabs 170. The tabs 170 and recesses 168 are positioned such that when the halves 142 are aligned, opposing tabs 170 are received within opposing recesses 168 and press fit to securely join the halves 142 together along a plane 141 (FIGS. 2 and 3) of separation running parallel to the axis of the housing.

After the subassembly has been formed by pressing the halves 142 together with the center conductor 116 in place, the subassembly is press fit into the housing 102 until forward portion 162 abuts an inwardly protruding ring 174 (FIG. 4) on the front end 104 of the housing. Afterward, the rear end 106 of the housing 102 is coined or rolled over to form a rear flange 176 (FIG. 4) to capture the rear enlargement 146.

With the structure thus described, the center conductor 116 is restricted from both axial and rotational movement. Further, the geometry thus described provides for an enhanced impedance matching and tuning.

From the foregoing detailed description of the present invention, it has been shown how the objects of the invention have been attained in a preferred manner. Modifications and equivalence of the disclosed concepts such as those which readily occur to one skilled in the art are intended to be included within the scope of the claims which are appended hereto.

What is claimed is:

1. A coax connector comprising:

an electrically conductive housing having an internal bore extending through an entrance end of said housing;

an electrically conductive center conductor having a body portion and a contact portion, said contact portion including at least two spring members extending from said body portion and terminating at distal ends, opposing surfaces of said spring members defining a pin receiving bore having an insert end at said distal ends, said spring members resilient so as to be urged apart from a rest position to a deflected position upon insert of a pin into said insert end of said pin receiving bore with said spring members biased into electrical contact with said pin;

said body portion having a first diameter portion adjacent said contact portion and a second diameter portion smaller than said first diameter portion on a side of said first diameter portion opposite said contact portion, said body portion further having an annular and radially extending stop surface facing toward said second diameter portion;

a dielectric support for holding said center conductor axially positioned within said internal bore with said distal ends and said insert end exposed at said first end of said housing;

said support including a first enlarged portion and a second enlarged portion each sized to be snugly received within said internal bore, said support further including a reduced sized portion joining said first and second enlarged portions with said reduced sized portion spaced from said housing to define an annular air chamber surrounding said reduced sized portion;

said support having a support bore extending through said first and second enlarged portions and said reduced sized portion, said support bore including a having first portion sized and positioned to surround said body portion in close contact, said bore including first and second diameter portions with a bore stop surface there between for said first and second diameter portions sized to surround and contact said first and second diameter portions of said body portion and with said bore stop surface opposing said annular and raised stop surface;

said support bore having a second portion sized and positioned to surround said spring members and spaced therefrom when said spring members are in said rest position by a spacing sized to accommodate movement of said spring members to said deflected position and to restrict subsequent movement of said spring members to a plastic deformation position; and a plurality of penetrating raised members on said body portion adapted to penetrate into said support to resist rotation and movement of said center conductor relative to said support.

2. A coax connector according to claim 1 wherein said support further includes a forward portion positioned between said entrance end and said distal ends with said forward portion having an axial opening exposing said insert end of said pin receiving bore.

3. A coax connector according to claim 1 wherein said support includes a first half and a second half joined at a plane extending along an axis of said internal bore.

4. A coax connector according to claim 3 wherein said first and second halves are identically configured.

5. A coax connector according to claim 3 wherein said first enlarged portion of said support surrounds said contact portion of said center conductor and includes radially extending vanes parallel to said axis with opposing surfaces of said vanes defining a plurality of air cavities surrounding said contact portion.

6. A coax connector according to claim 5 wherein said air cavities and said air chamber are selected for said coax connector to have a characteristic impedance of 75 ohms.

* * * * *

UNITED STATES PATENT AND TRADEMARK OFFICE

CERTIFICATE OF CORRECTION

PATENT NO. : 5,730,622

DATED : March 24, 1998

INVENTOR(S) : Olson

It is certified that error appears in the above-identified patent and that said Letters Patent is hereby corrected as shown below:

In claim 1, column 6, line 24, delete the word "having".

Signed and Sealed this

Ninth Day of February, 1999

*Attest:*

*Acting Commissioner of Patents and Trademarks*

*Attesting Officer*